US007571693B2

(12) United States Patent
Tipaldo

(10) Patent No.: US 7,571,693 B2
(45) **Date of Patent: *Aug. 11, 2009**

(54) CONDENSED RETRACTABLE SAFETY MARKER

(76) Inventor: John M. Tipaldo, 405 Beach 132st, Belle Harbor, NY (US) 11694

( * ) Notice: Subject to any disclaimer, the term of this patent is extended or adjusted under 35 U.S.C. 154(b) by 0 days.

This patent is subject to a terminal disclaimer.

(21) Appl. No.: 11/833,447

(22) Filed: Aug. 3, 2007

(65) Prior Publication Data

US 2007/0266925 A1 Nov. 22, 2007

Related U.S. Application Data

(63) Continuation of application No. 11/097,576, filed on Apr. 4, 2005, now Pat. No. 7,261,051.

(51) Int. Cl.
*E01F 9/00* (2006.01)
*E01F 9/012* (2006.01)

(52) U.S. Cl. ..... 116/63 C; 116/63 P; 40/612; 404/9

(58) Field of Classification Search ..... 116/63 C, 116/63 P, 63 T, 28 R, 173, 200; 40/608, 610, 40/612; 33/296, 809; 404/6, 9, 10
See application file for complete search history.

(56) References Cited

U.S. PATENT DOCUMENTS

| | | | | |
|---|---|---|---|---|
| 2,762,327 | A | 9/1956 | Weig | |
| 2,954,005 | A | 9/1960 | Cioffi et al. | |
| 3,132,624 | A | 5/1964 | Shoemaker, Jr. | |
| 3,256,853 | A * | 6/1966 | Underwood | 116/63 R |
| 3,496,904 | A | 2/1970 | Rimkus | |
| 3,520,235 | A | 7/1970 | Palazzolo et al. | |
| 4,006,702 | A | 2/1977 | St. Cyr | |
| 4,038,769 | A * | 8/1977 | Werner | 40/610 |
| 4,197,807 | A | 4/1980 | Campbell | |
| 4,256,050 | A | 3/1981 | Barnard | |
| 4,462,145 | A | 7/1984 | Schulze | |
| 4,466,376 | A | 8/1984 | Wells | |
| 5,287,822 | A | 2/1994 | Anderson | |
| 5,305,705 | A * | 4/1994 | Gagliano | 116/63 P |
| 6,115,951 | A * | 9/2000 | Jing et al. | 40/610 |
| 6,508,195 | B1 * | 1/2003 | Tipaldo | 116/63 P |
| 6,681,715 | B2 * | 1/2004 | Wood | 116/63 P |
| 7,007,630 | B2 * | 3/2006 | Garcia | 116/63 C |

(Continued)

*Primary Examiner*—Amy Cohen Johnson
(74) *Attorney, Agent, or Firm*—The Farrell Law Firm, PC; Michael J. Musella

(57) ABSTRACT

A condensed retractable traffic cone is a device designed to provide motorists with advance warning of disabled vehicles and/or work zone areas. The device has been designed to withstand reasonable winds through the use of two base supports, a lower portion, a retractable arm and a series of retractable vertical risers. The retractable vertical risers in combination with a retractable arm allow for the device to easily expand to height consistent with traffic engineering design standards when in operation and then compact when it is in storage. The two base supports are designed not only to provide the necessary structural stability but to also open and close about the retractable vertical risers thus providing for additional compactness. The vertical risers are designed with flexible hinges so that they may store flat and expand to a rectangular shape when the base supports are rotated to an open position, accomplished a by linkage connecting the lower vertical riser and the base supports.

8 Claims, 6 Drawing Sheets

U.S. PATENT DOCUMENTS 7,258,506 B2 * 8/2007 Tipaldo ..... 404/9
7,261,051 B2 * 8/2007 Tipaldo ..... 116/63 P
2007/0214694 A1 * 9/2007 Huang ..... 40/610

* cited by examiner

CONDENSED RETRACTABLE SAFETY MARKER

PRIORITY

This application is a continuation of application Ser. No. 11/097,576 filed on Apr. 4, 2005 now U.S. Pat. No. 7,261,051, the contents of which are incorporated herein by reference.

BACKGROUND OF THE INVENTION

This application relates to means of alerting motorists to the presence of disabled vehicles or work zone areas. Each year hundreds of motorists are either killed or injured along side the roadway. Many of these accidents may be prevented if the oncoming motorist had advance warning of the presence of these disabled vehicles.

In recent years, a variety of traffic warning devices have become known and reference may be had to the following U.S. patents for a description of these prior art of traffic warning devices; U.S. Pat. Nos. 6,508,195, 6,681,715, 2,954,005, 3,496,904, 4,006,702, 4,197,807, 4,256,50, 2,762,327, 3,132,624, 3,520,235, 4,462,145, 4,466,376 and 5,287,822.

Over the years there have been many attempts to provide a retractable or collapsible traffic cone. Designs have spanned from sleeves of varying diameter and taper which when extended fit into one another and form a cone shaped marker, for example in U.S. Pat. Nos. 2,954,005 and 3,496,904. Another variation of the concept is found in U.S. Pat. No. 2,762,327 where the device is inflatable and is attached to a solid base and filled with air when ready for use. Other designs have employed the varied use of coils or springs as a means of displaying the traffic control device. These devices are outlined in U.S. Pat. Nos. 4,006,702, 4,256,050, 4,197,807, 4,256,050 and 5,305,705.

Other designs have employed the use of springs and a flexible membrane, for example in U.S. Pat. No. 3,132,624, and a two-piece center support member. U.S. Pat. No. 3,520,235 describes a device that requires assembly prior to use and employs a two-piece center support pole.

In other designs three and four sided panel fan shaped members, for example in U.S. Pat. Nos. 4,466,376 and 4,462,145, are employed to form upright three and four sided triangles respectively.

While this has long been recognized as a traffic safety problem many needless deaths and injuries continue to happen every year.

SUMMARY OF THE INVENTION

Accordingly, the present invention has been made to solve at least the above-mentioned problems occurring in the prior art, and an object of the present invention is to provide a condensed retractable traffic cone.

To accomplish the above objects, there is provided a condensed retractable traffic cone, that includes a lower portion comprised of a flat bottom section; a first and a second base support, each base support having a bottom with no top, two short sides and a long side, the short sides of the first base support foldable at a first position about the lower portion, and the short sides of the second base support foldable at a second position about the lower portion; a retractable arm comprised of at least two collapsible hollow vertical risers that fit within each other, each collapsible hollow vertical riser having a collapsed position and an expanded position; a lower riser of the least two collapsible hollow vertical risers having a plurality of rotatable connections between the lower of the at least two collapsible hollow vertical risers and the first and the second base support; and an upper riser of the least two collapsible hollow vertical risers being extendable from the lower riser of the least two collapsible hollow vertical risers, wherein when the base supports are in an unfolded open position, the at least two collapsible hollow vertical risers are maintained in the expanded position due to a pulling force of the base supports on the lower riser of the at least two collapsible hollow vertical risers through the connections, and when the base supports are in a folded closed position, the at least two collapsible hollow vertical risers are maintained in the collapsed position due to a pushing force of the base supports on the least two collapsible hollow vertical risers.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Figure 1:
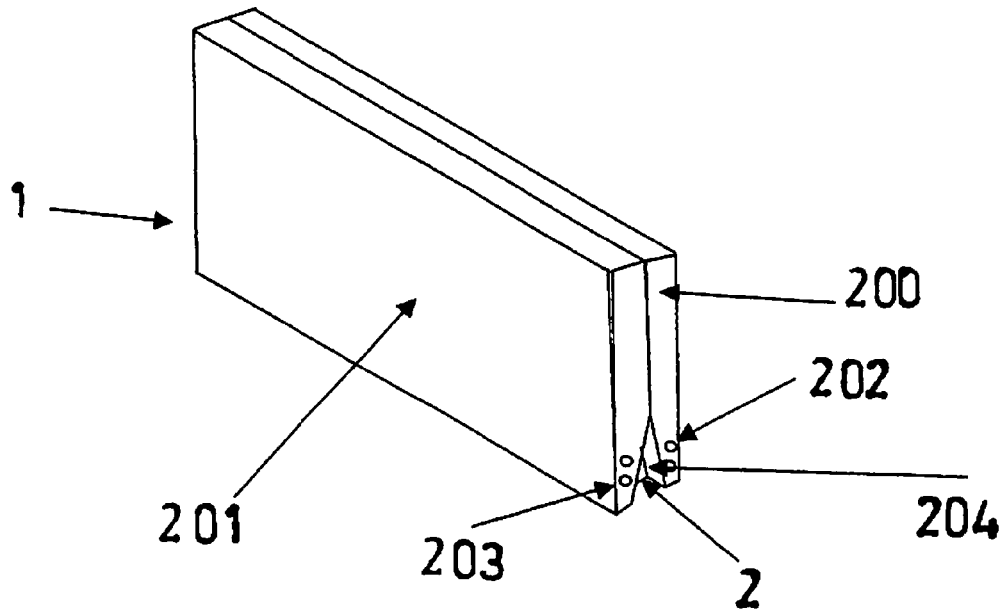
FIG. 1 is a perspective view of the current invention in the retracted and closed position.

Hereinafter, a preferred embodiment of the present invention will be described in detail with reference to the accompanying drawings. Note that the same or similar components in drawings are designated by the same reference numerals as far as possible although they are shown in different drawings. In the following description of the present invention, a detailed description of known functions and configurations incorporated herein will be omitted when it may make the subject matter of the present invention rather unclear.

Reference will now be made to the drawings in which the various elements of the present invention will be given numerical designations. In its present form the invention consists of several distinct elements. These elements when combined as described within will allow one of ordinary skill in the art to made and use the present invention.

Current methods of enhancing motorist awareness of safety hazards include flares, solid plastic cones and collapsible or spring cones. The presented invention is designed to eliminate current difficulties encountered with the use of existing road safety devices. With roadside flares there is the inherent short fall that they only last a given period of time and are nor reusable. In addition, they are usually only several inches above the roadway service and may present difficulty in operating. Solid plastic cones are easy to place along the roadway, however, unless they are properly weighted and sized they may be displaced due to strong gusts of winds. In addition, the larger the cone the more storage space that is required. This is a disadvantage (especially in small passenger vehicles) and therefore reduces their attractiveness of the use. In recent years several collapsible or spring traffic cones have been introduced into the market place.

The present invention is a significant improvement to these designs since the use of the flexible hinges on the vertical risers and the use of a rotating base support allows requires approximately ½ the necessary storage space. In addition, when compared to the designs that require springs, for example U.S. Pat. No. 5,305,705, the present invention is totally self-contained and does not require any additional locking mechanism when storing. The reduced storage space significantly increases the attractiveness of the present invention, especially in emergency response vehicles where space is at a premium.

The vertical risers may be described as a rectangular or trapezoidal shaped flexible box where the top and bottom sides are open. The vertical risers are designed to fit within each other and are designed with flexible hinges extending its entire length on each corner so that they may store relatively flat. In U.S. Pat. No. 6,508,195 two retractable arms are used as a means of expanding the porous casing from a compact to expanded position. In the present invention, the two retractable arms are replaced by a single retractable arm placed in the center of the lower portion as is used as a means of expanding the series of vertical risers from a compact to expanded position. As in U.S. Pat. No. 6,508,195 the base supports are connected to the lower portion by a series of protruding tabs and holes. In the present invention, the lower vertical riser is connected to the base supports by a lower linkage that allows the series of vertical risers to transform from a relatively flat position in storage to a rectangular shape when the base support goes from a closed to an open position when rotated about the lower portion. In addition, the upper vertical riser is also linked to the upper portion of the retractable arm. This upper linkage allows for the vertical risers to be lifted from a compact to expanded position when the retractable arm is fully expanded. In order to help accomplish this movement the upper portion of the retractable arm contains a handle.

The condensed retractable traffic cone has been designed to be employ easily, store compactly, withstand prevailing winds and be economical.

The condensed retractable traffic cone is a combination of several pieces. The first two pieces are referenced to as the base supports. The base supports are similar in design and function to the base supports disclosed in U.S. Pat. No. 6,508,195. The base supports are connected to the lower portion in a similar manner as taught in U.S. Pat. No. 6,508,195. Connected to the lower portion is a single retractable arm with a handle on its upper portion. When the device is fully deployed the retractable arm is perpendicular to the base supports. When the device is in storage the retractable arm is parallel to the base supports. In the present invention the porous casing taught in U.S. Pat. No. 6,508,195 is replaced by a series of vertical risers. Each vertical riser is designed with hinges along each corner that extend its entire length. This design allows for the vertical rises to be able to change shape when pressure is applied. The vertical risers are designed to fit within each other and may either be rectangular or slightly tapered. In order to reduce wind load on the sign support structure, the each vertical riser may be designed with airflow holes. Also the bottom portion of the retractable arm may be designed in the shape of a spring that would allow for the slight deflection of the present invention when subject to high wind loads. Allowing for this slight deflection may reduce the overall weight of the device thereby potentially reducing its cost.

In addition, reflective decals may be affixed to the vertical risers to correspond with traffic control device design standards. The actual number of vertical risers employed depends on application.

The two base supports are intended to provide the necessary weight to ensure that the device is not displaced under reasonable wind loads. Each base support also has several strategically placed tabs. The base support is primarily a rectangular type box with the top end and one of the sides open. The long sides of the base support contain a tab at the open end of the box. These tabs are designed to allow the base support to be affixed to holes in the lower portion. The lower portion has been designed with protruding tabs.

The condensed retractable traffic cone has been designed for easy placement during emergency situations. The first step in the application process is to rotate the two base supports from the closed to the open position and locked (parallel with the lower portion). After the base support is fixed in the open position, the series of vertical risers is then expanded by simply pulling in a vertical manner the handle on the upper portion of the retractable arm. This is continued until all the vertical risers are in fully extended position. At this point the invention is ready for application.

The present invention offers an improvement over the previous designs in that the base support has been designed to fold in half thereby significantly reducing the necessary storage space when compared to similar sized designs. Through the use of hinged vertical risers that store effectively flat when not in operation and then open when in operation, significantly also reduces the necessary storage space when compared to devices that use a rigid sleeve design. This improved storage efficiency in both the base support and the vertical risers increases the attractiveness of the present invention to the user since it requires significantly less storage space when compare to the current state of the art. This is especially essential when the users are the highway motorcycle patrol or motorcyclists in general. The present invention has been designed to fit into the side compartment of their motorcycle. This is envisioned as a primary application for the present invention.

In addition when compared to spring or coil type devices the present invention does not require any additional locking mechanism. Also when compared to some previous designs the present invention is totally self-contained and requires no assembly prior to implementation.

Further, the device has been designed so that reflective decals can be directly affixed to the device to alert motorists. Several other designs, especially those that require the use of a spring or a coil require the use of a flexible reflective material. Reflective decals (similar to those used on existing traffic control devices) are usually brittle and would crack when stored in a compressed position, therefore they would not be recommended for many of the previously discussed prior designs. Reflective tape may also be used in many of the previously disclosed designed. While less brittle than decals they have a problem with wrinkling when compressed. A primary benefit of the use of reflective decals or tape is the reduced cost when compared to collars currently used on rigid traffic cones and on several existing collapsible devices.

FIG. 1 illustrates the present invention in the closed and contracted position, illustrating the base support (1) having two short sides (200) and one long side (201) and the lower portion (2). The base support further includes upper section tabs (202) and lower section tabs (203).

Figure 2:
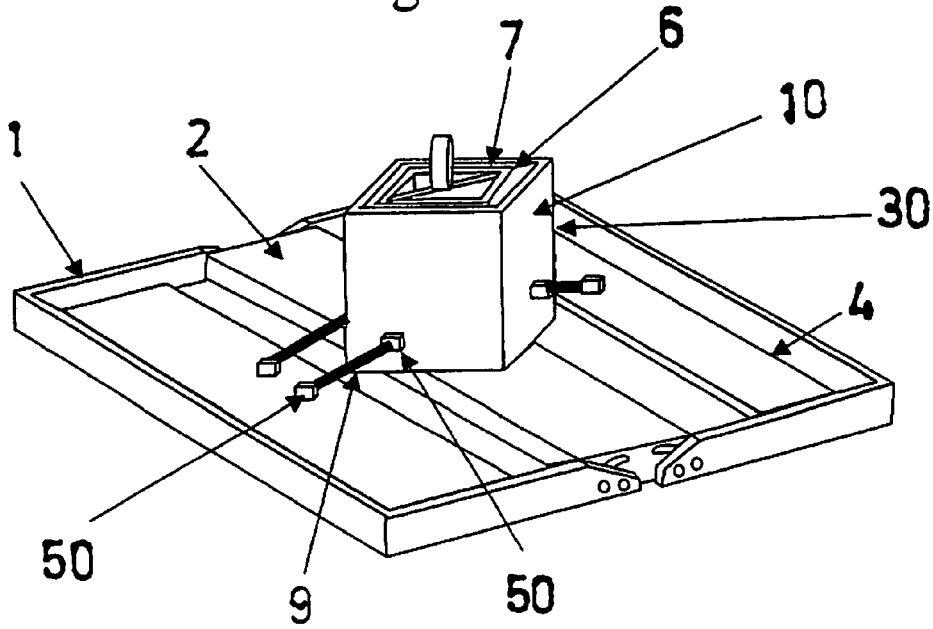
FIG. 2 is a side view of the current invention in the retracted and open position.

FIG. 2 illustrates the present invention in the open and contracted position. By rotating the base supports (1) about the lower portion (2), the ball-in-socket design (50) and the lower linkages (9) effectively pull the lower (10), middle (6) and upper (7) rectangular shaped hollow vertical risers from a relatively flat shape when stored to an open hollow shape. When the device is readied for storage, the base supports (1) are rotated about the lower portion (2) and the lower linkages (9) effectively push the lower (10), middle (6) and upper (7) rectangular shaped hollow vertical risers from an open hollow shape to a relatively flat shape when the base support (1) is fully closed.

Figure 3:
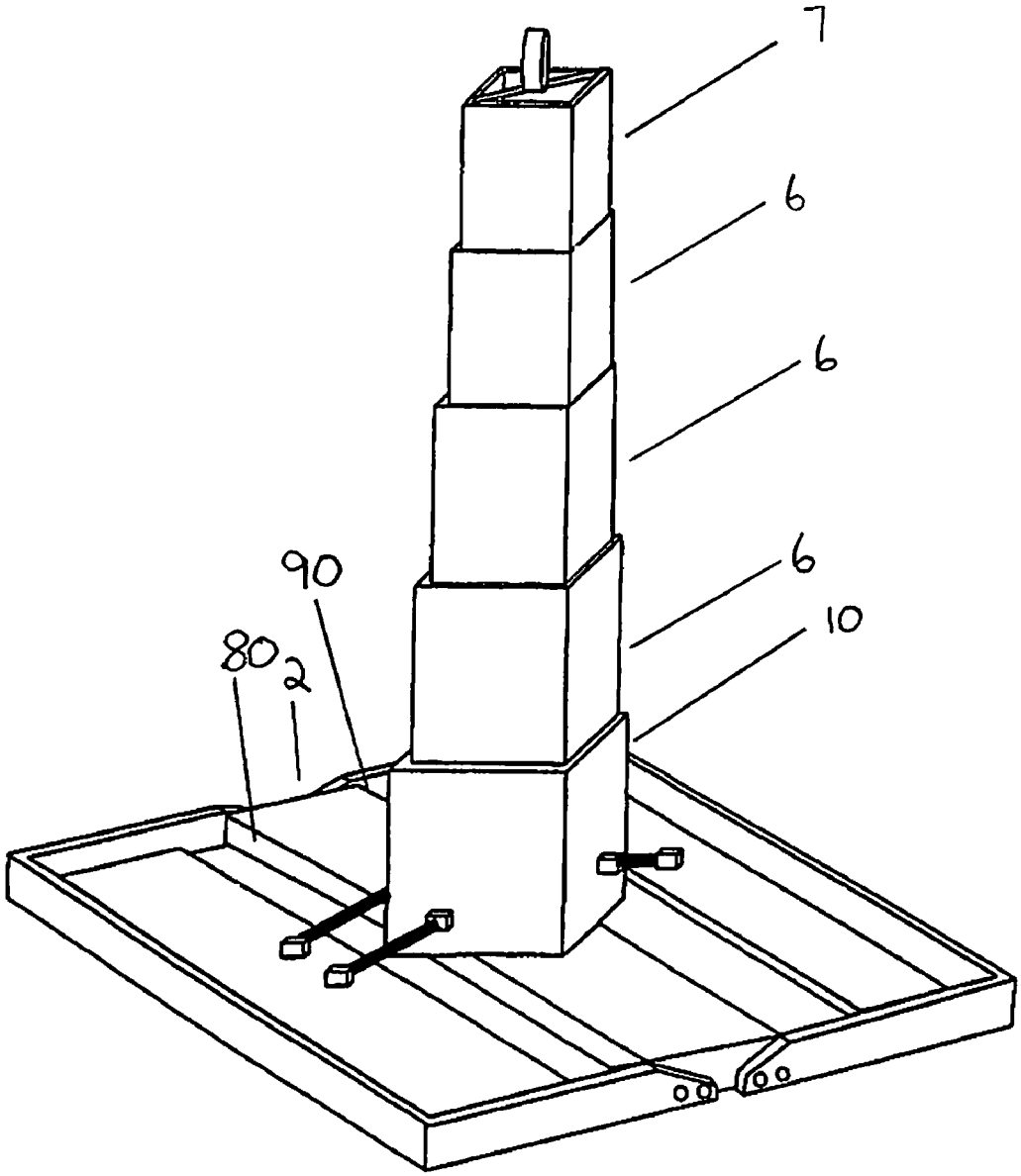
FIG. 3 is a perspective view of the current invention in the expended and open position.

FIG. 3 illustrates the present invention in the open and expanded position, illustrating the lower (10), middle (6) and upper (7) rectangular shaped hollow vertical risers in the fully extended position. Lower portion (2) has a first edge (80) and a second edge (90). First edge (80) is opposite second edge (90).

Figure 4:
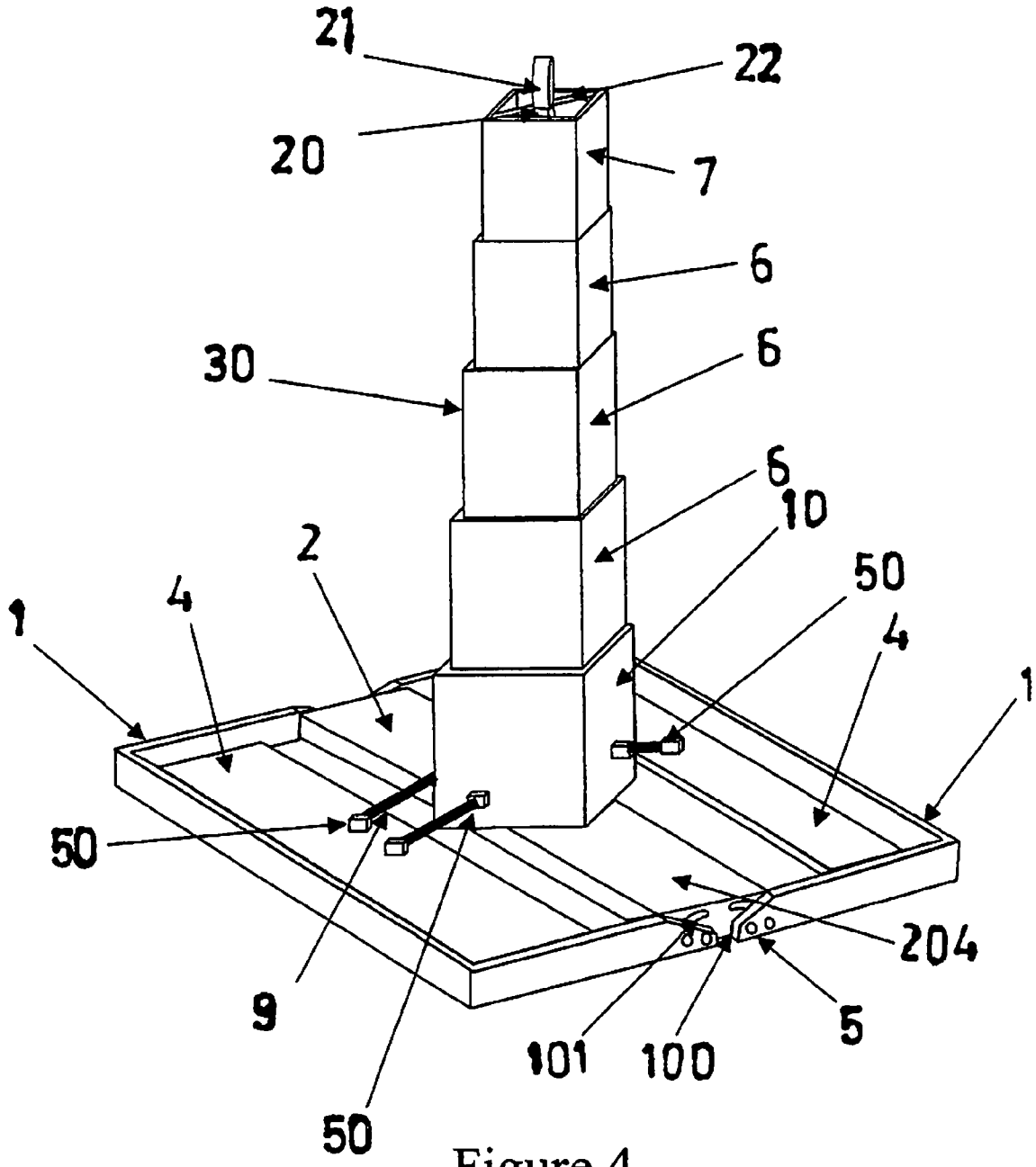
FIG. 4 is a perspective view of the current invention in the expended and open position illustrating reference numerals.

Referring to FIG. 4, the lower portion (2) contains a series of holes (100) and slots (101) that allow for the base supports (1) to be attached by use of the protruding tabs (5). Other methods of rotatably attaching the base supports (1) to the lower portion (2) such that the base supports can fold about a retractable arm (20) are well known in the art and contemplated herein. For example, a simple rivet can be used to attach the base supports (1) to the lower portion (2).

Attached to the lower portion (2) is a retractable arm (20) consisting of several sections that fit within each other. Contained within the base supports (1) are support weights (4). These support weights (4) are designed to help the total sign support structure resist displacement under high wind conditions. Also contained between the base supports (1) and the lower portion (2) are lower linkages (9) that allow for movement of the flexible hinges (30) on the series of vertical risers that allow its shape to change from a relatively flat to a trapezoidal or rectangular hollow shape. The lower linkage (9) is connected by a ball-in-socket type design (50) to the base support (1) and the lower vertical riser (10). Contained within the lower vertical riser (10) is a series of middle vertical risers (6) capable of extending into a fixed position when the upper vertical riser (7) is extended to its maximum height by lifting the retractable arm (20). The upper vertical riser (7) is connected to the retractable arm (20) by an upper linkage (22) that allows for the lifting of the lower (10), middle (6) and upper (7) rectangular shaped hollow vertical risers when the retractable arm (20) is extended. The retractable arm (20) is extended into a fully vertical position by lifting the handle (21).

Figure 5:
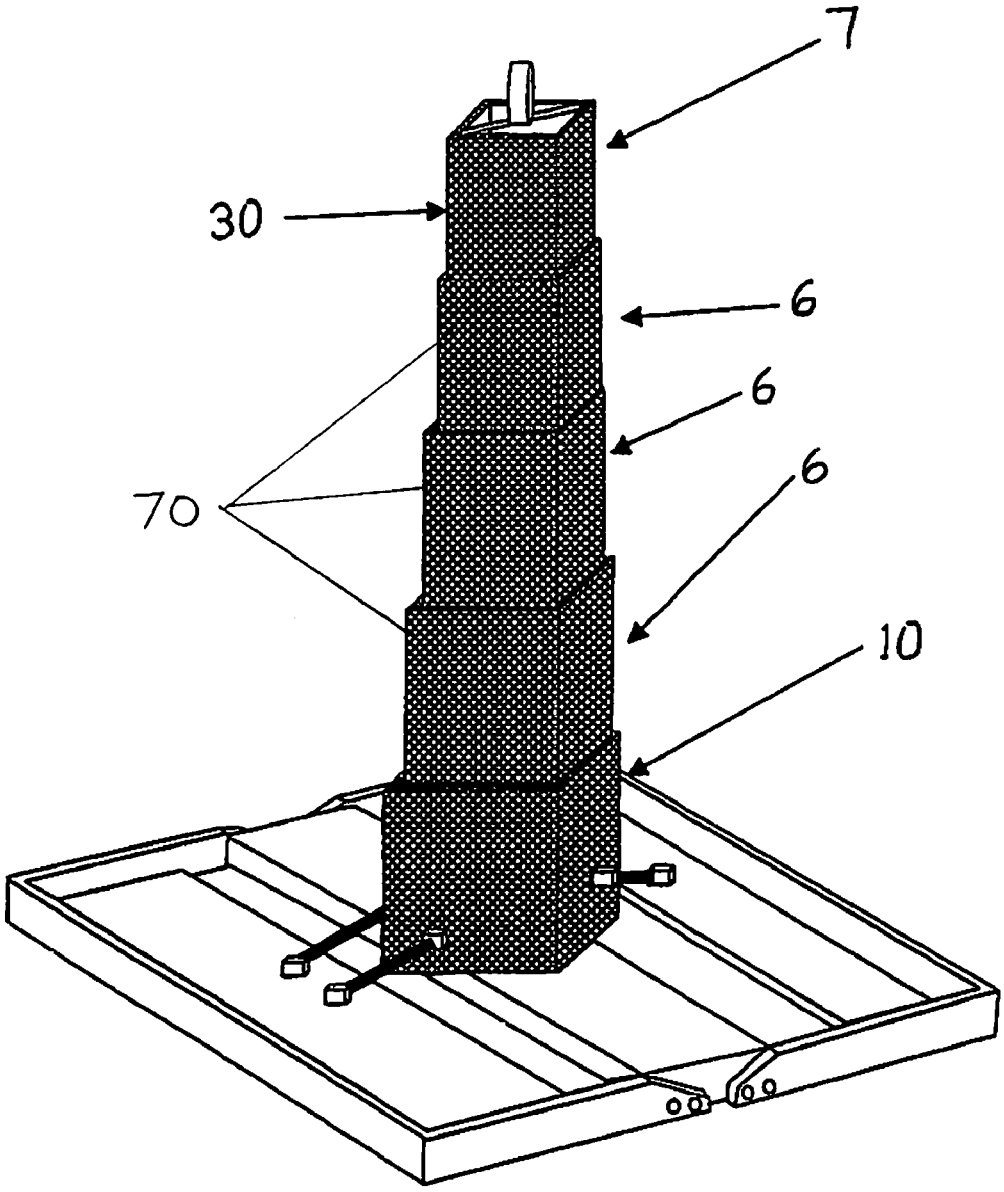
FIG. 5 is a perspective view of the current invention in the expended and open position illustrating the air-flow holes in the series of vertical risers.

A second embodiment is illustrated in FIG. 5. As illustrated in FIG. 5, the lower (10), middle (6) and upper (7) rectangular shaped hollow vertical risers may be designed with air-flow holes (70) as to reduce the overall wind load on the structure.

Figure 6:
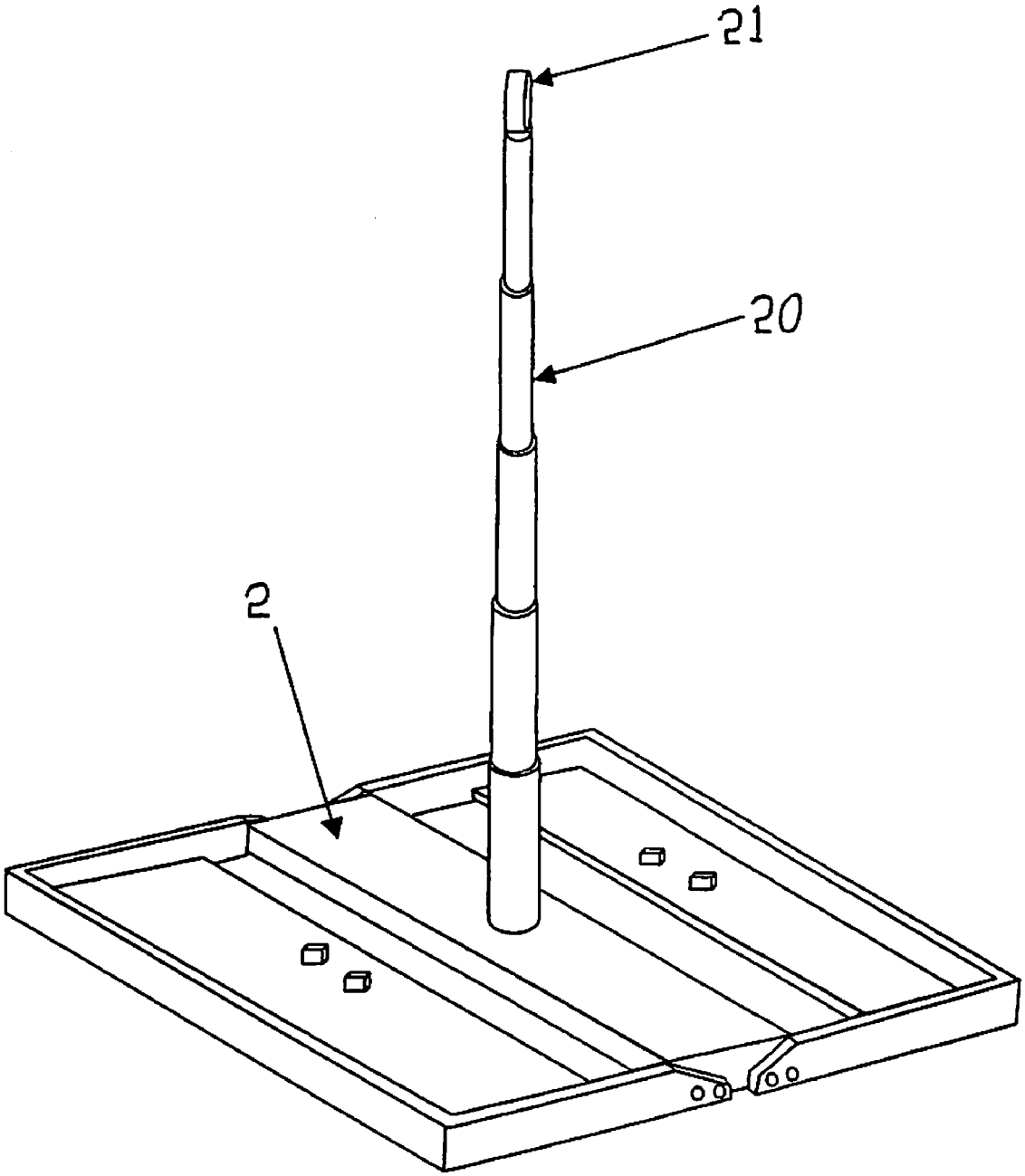
FIG. 6 is a perspective view of the current invention in the expended and open position without the vertical risers illustrating the retractable arm.

FIG. 6 illustrates a third embodiment of the present invention, in the open and expanded position without the vertical risers and is intended to show the placement of the retractable arm (20) in relation to the base supports (1) and the lower portion (2).

Figure 7:
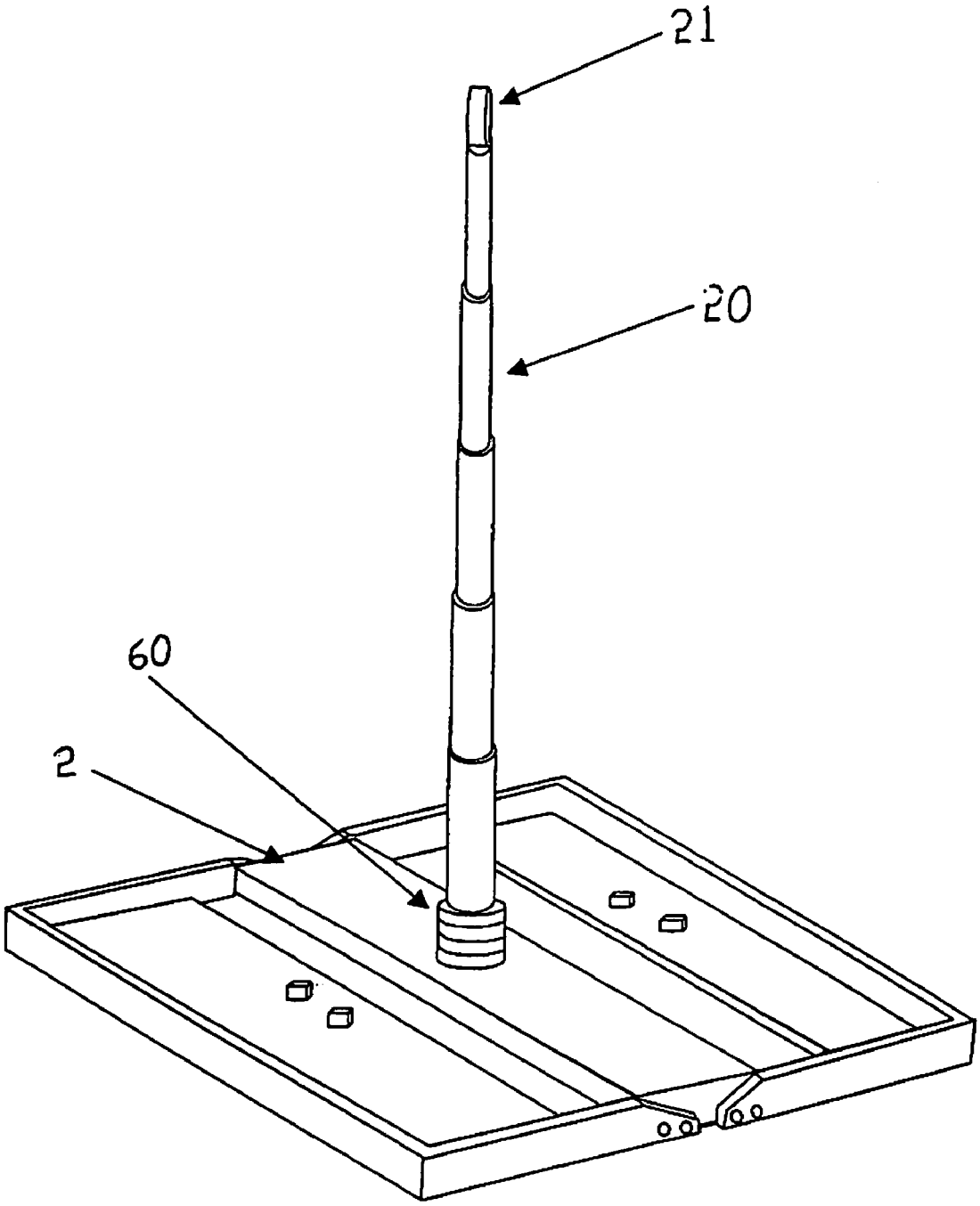
FIG. 7 is a perspective view of the current invention in the expended and open position without the vertical risers illustrating the spring design of lower portion of the retractable arm.

A fourth embodiment is illustrated in FIG. 7. As illustrated in FIG. 7, the lower portion of the retractable arm (20) may be designed in the shape of a spring (60) to allow for greater flexibility of the device. This flexibility would allow for temporary slight displacement of the lower (10), middle (6) and upper (7) rectangular shaped hollow vertical risers under high wind conditions, thus reducing the necessary weight of the support weights (4).

To deploy the current invention, the user simply rotates the two base supports (1) about the lower portion (2) into a locked position perpendicular to the retractable arm (20), and then lifts the series of the lower (10), middle (6) and upper (7) rectangular shaped hollow vertical risers into a locked vertical position by use of the handle (21) on the upper portion of the retractable arm (20). The devise is now ready for use.

While the invention has been shown and described with reference to certain preferred embodiments thereof, it will be understood by those skilled in the art that various changes in form and details may be made therein without departing from the spirit and scope of the invention. Consequently, the scope of the invention should not be limited to the embodiments, but should be defined by the appended claims and equivalents thereof

What is claimed is:

1. A condensed retractable traffic cone, comprising:

a lower portion comprised of a flat bottom section;

a first and a second base support, each base support having a bottom with no top, two short sides and a long side, the short sides of the first base support foldable at a first position about the lower portion, and the short sides of the second base support foldable at a second position about the lower portion;

a plurality of vertical risers comprised of at least two collapsible hollow vertical risers that fit within each other, each collapsible hollow vertical riser having a collapsed position and an expanded position;

a lower riser of the at least two collapsible hollow vertical risers having a plurality of rotatable connections between the lower of the at least two collapsible hollow vertical risers and the first and the second base support; and an upper riser of the at least two collapsible hollow vertical risers being extendable from the lower riser of the at least two collapsible hollow vertical risers, wherein when the base supports are in an unfolded open position, the at least two collapsible hollow vertical risers are maintained in the expanded position due to a pulling force of the base supports on the lower riser of the at least two collapsible hollow vertical risers through the connections, and when the base supports are in a folded closed position, the at least two collapsible hollow vertical risers are maintained in the collapsed position due to a pushing force of the base supports on the at least two collapsible hollow vertical risers.

2. The condensed retractable traffic cone of claim 1, wherein the rotatable connections are ball and socket connections.

3. The condensed retractable traffic cone of claim 1, wherein the upper riser of the at least two collapsible hollow vertical risers has a handle affixed to its top.

4. The condensed retractable traffic cone of claim 1, wherein the at least two collapsible hollow vertical risers are designed with air-flow holes.

5. A condensed retractable traffic cone, comprising:

a lower portion comprised of a flat bottom section;

a first and a second base support, the first base support foldable at a first edge of the lower portion and the second base support foldable at a second edge of the lower portion, the second edge being opposite to the first edge;

a plurality of vertical risers comprised of at least two vertical risers that fit within each other, a lower riser of the at least two vertical risers, and an upper riser of the at least two vertical risers being extendable from the lower riser of the at least two vertical risers, each of said plurality of vertical risers having a collapsed state and an expanded state, and creating a volume area defined by said plurality of vertical risers;

a retractable arm contained within the volume area and attached at a lower end to a top surface of the lower portion and at an upper end to a top of the upper vertical riser, wherein the first and second base supports are foldable about the plurality of vertical risers and enclose the plurality of vertical risers when the plurality of vertical risers are unextended and in a collapsed state.

6. The condensed retractable traffic cone of claim 5, wherein the upper riser of the at least two vertical risers has a handle affixed to its top.

7. The condensed retractable traffic cone of claim 5, wherein the at least two vertical risers are designed with air-flow holes.

8. The condensed retractable traffic cone of claim 5, wherein the retractable arm is connected to the lower portion via a spring-shaped element.

* * * * *